United States Patent [19]

Scaduto

[11] 4,116,233

[45] Sep. 26, 1978

[54] PORTABLE MASSAGER

[75] Inventor: Francis J. Scaduto, Rockford, Ill.

[73] Assignee: The Raymond Lee Organization, Inc., New York, N.Y. ; a part interest

[21] Appl. No.: 776,987

[22] Filed: Mar. 14, 1977

[51] Int. Cl.[2] ..... A61H 1/00; A61H 15/00

[52] U.S. Cl. ..... 128/32; 128/57

[58] Field of Search ..... 128/57, 58, 24.3, 67, 128/41, 32

[56] References Cited

U.S. PATENT DOCUMENTS

| | | | |
|---|---|---|---|
| 1,947,042 | 2/1934 | Glennan | 128/57 |
| 2,988,084 | 6/1961 | Douglas | 128/41 |

FOREIGN PATENT DOCUMENTS

| | | | |
|---|---|---|---|
| 245,637 | 4/1912 | Fed. Rep. of Germany | 128/41 |
| 591,232 | 5/1934 | Fed. Rep. of Germany | 128/57 |
| 137,038 | 2/1930 | Switzerland | 128/57 |
| 314,282 | 6/1929 | United Kingdom | 128/57 |

*Primary Examiner*—Lawrence W. Trapp

*Attorney, Agent, or Firm*—Daniel Jay Tick

[57] ABSTRACT

A housing of hand-size has a handle mounted thereon to accommodate a hand of a user with the palm of the hand on the housing. A massage ball is mounted in the housing and protrudes therefrom for free universal rotation. A motive device in the housing abuts the massage ball and imparts vibration and motion to said massage ball.

1 Claim, 3 Drawing Figures

FIG. 1
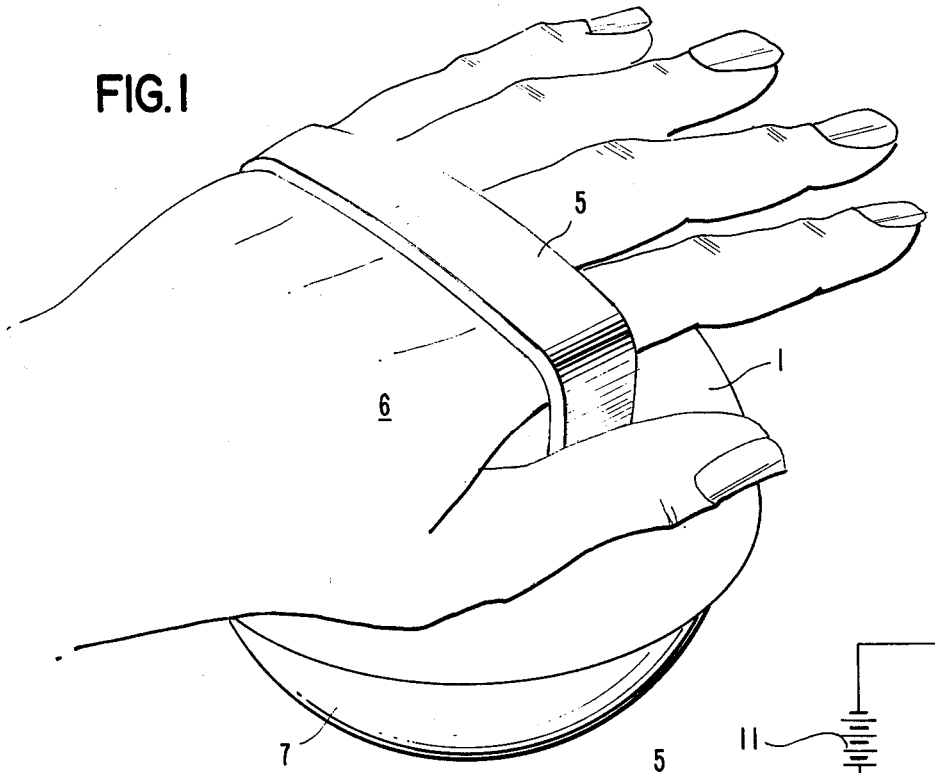
FIG. 3
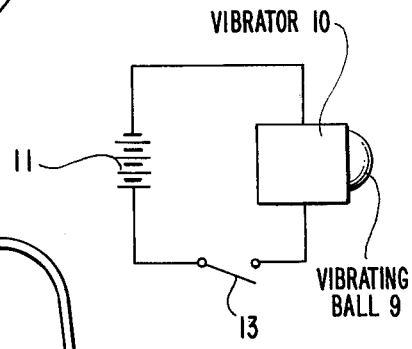
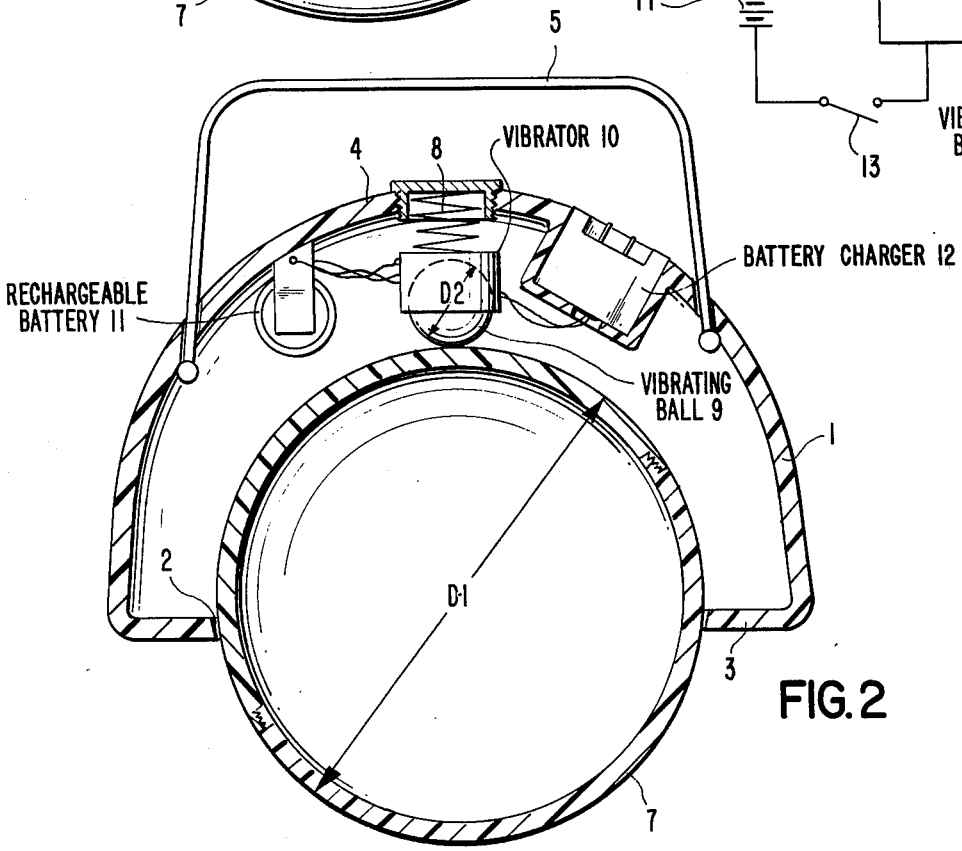
FIG. 2

PORTABLE MASSAGER

BACKGROUND OF THE INVENTION

The present invention relates to a portable massager.

Objects of the invention are to provide a portable massager of simple structure, which is inexpensive in manufacture, light in weight, easily handled, fits into the palm of the hand of a user with facility and convenience, safe to use, and functions efficiently, effectively and reliably to massage any desired part of the body.

BRIEF DESCRIPTION OF THE DRAWINGS

In order that the invention may be readily carried into effect, it will now be described with reference to the accompanying drawings, wherein:

FIG. 1 is a perspective view of an embodiment of the portable massager of the invention supported by a hand of the user;

FIG. 2 is a view, partly in section, of the portable massager of the invention; and FIG. 3 is a circuit diagram of the portable massager of the invention.

DETAILED DESCRIPTION OF THE INVENTION

The portable massager of the invention comprises a hand-sized housing 1 (FIGS. 1 and 2) having a hole 2 formed through a first side 3 thereof (FIG. 2). The housing 1 has a second side 4, opposite the first side 3, as shown in FIG. 2.

A handle 5 (FIGS. 1 and 2) is mounted on the second side 4 of the housing 1 to accommodate a hand 6 (FIG. 1) of a user with the palm of the hand on said second side, as shown in FIG. 1, whereby the housing is supported by the hand.

A massage ball 7 (FIGS. 1 and 2) of predetermined diameter D1 (FIG. 2), larger than the diameter of the hole 2 through the first side 3 of the housing, is mounted in the housing 1 for free universal rotation in said hole. Less than half the ball 7 protrudes from the hole 2, as shown in FIG. 2.

A motive device in the housing 1 abuts the massage ball 7 and imparts vibration and motion to said massage ball. The motive device comprises a vibrating ball spring 8 biasedly mounted in the housing 1 (FIG. 2). A vibrator 10 (FIGS. 2 and 3) is mounted in the housing on the vibrating ball spring 8 and accommodates a vibrating ball 9 (FIGS. 2 and 3) in abutment with the massage ball 7. The vibrator 10 vibrates the vibrating ball 9. The vibrating ball 9 has a diameter D2 (FIG. 2) smaller than the predetermined diameter D1 of the massage ball.

A rechargeable battery 11 in the housing 1 is electrically connected to the vibrator 10 for operating said vibrator (FIGS. 2 and 3). The battery 11 is charged via a battery charger 12 (FIG. 2). The massager is operated via an ON/OFF switch 13 (FIG. 3).

While the invention has been described by means of a specific example and in a specific embodiment, I do not wish to be limited thereto, for obvious modifications will occur to those skilled in the art without departing from the spirit and scope of the invention.

I claim:

1. A portable massager, comprising a hand-sized housing having a hole formed through a first side thereof, said housing having a second side opposite the first side;

a handle mounted on the second side of the housing to accommodate a hand of a user with the palm on the second side whereby the housing is supported by the hand;

a massage ball of predetermined diameter larger than that of the hole through the first side of the housing mounted in the housing for free universal rotation in said hole whereby less than half the ball protrudes from said hole; and motive means in the housing abutting the massage ball for imparting vibration and motion to said massage ball, said motive means comprising a vibrating ball spring biasedly mounted in the housing, a vibrating ball mounted on the spring in abutment with the massage ball, a vibrator mounted in the housing for vibrating the vibrating ball, said vibrating ball having a diameter smaller than the predetermined diameter and rechargeable battery means in the housing electrically connected to the vibrator for operating said vibrator.

* * * * *